US005588867A

United States Patent [19]

Thévenaz

[11] Patent Number: 5,588,867

[45] Date of Patent: Dec. 31, 1996

[54] CURVED SOCKET CONTACT

[75] Inventor: Armand P. Thévenaz, Auliens/Ollon, Switzerland

[73] Assignee: The Whitaker Corporation, Wilmington, Del.

[21] Appl. No.: 413,019

[22] Filed: Mar. 29, 1995

[30] Foreign Application Priority Data

Apr. 19, 1994 [GB] United Kingdom ..... 9407748

[51] Int. Cl.[6] ..... H01R 9/09; H01R 13/11

[52] U.S. Cl. ..... 439/381; 29/861; 439/380; 439/750; 439/752.5; 439/851

[58] Field of Search ..... 439/245, 380, 439/381, 445, 446, 447, 587, 588, 604, 750, 752.5, 841, 851; 29/861, 865, 866, 882

[56] References Cited

U.S. PATENT DOCUMENTS

| | | | |
|---|---|---|---|
| 3,157,455 | 11/1964 | Takano . | |
| 3,165,369 | 1/1965 | Maston | 439/380 |
| 3,614,296 | 10/1971 | Blomstrand et al. | 439/841 |
| 3,975,077 | 8/1976 | Peterson . | |
| 4,036,549 | 7/1977 | Honda et al. . | |
| 4,245,881 | 1/1981 | Michaels | 439/841 |
| 4,632,496 | 12/1986 | Williams | 439/841 |
| 4,750,897 | 6/1988 | Neidecker | 439/851 |
| 4,840,587 | 6/1989 | Lancella | 439/851 |
| 5,055,055 | 10/1991 | Bakker | 439/851 |
| 5,326,289 | 7/1994 | Leisey | 439/851 |

FOREIGN PATENT DOCUMENTS

| | | | |
|---|---|---|---|
| 1314507 | 12/1962 | France | 439/841 |

*Primary Examiner*—Gary E. Elkins

[57] ABSTRACT

A machined socket contact comprises a contact section having a cavity therein for receiving a male pin terminal. The contact section comprises slots extending alternately from opposite sides of the contact section and intersecting the cavity. The slots make the contact section supple in the bending direction such that the contact section can be inserted into a curved housing cavity section for receiving complementary curved male pins which are mated to the sockets by relative pivoting motion between the complementary pin and socket. The transverse slots enable the socket contact to be manufactured in a cost-effective manner whilst ensuring that the cavity profile remains relatively undeformed when bent into the curved shape. Plastic bending of a rigid cylinder with a cavity therein, would result in deformation of the cavity cross-sectional profile and would also be very expensive to manufacture.

9 Claims, 2 Drawing Sheets

CURVED SOCKET CONTACT

BACKGROUND OF THE INVENTION

1. Field of the Invention

This invention relates to a socket contact that is curved for pivot coupling of a complementary male pin terminal therein.

2. Description of the Prior Art

There is a need in some applications of the electrical connector industry, to provide a connector that is coupled to a complementary connector by a rotational movement therebetween. Such a connector could incorporate curved pins that are mounted on a first connector, and complementary curved sockets mounted on another connector, the connectors being rotated together about a pivot point whereby the curvature of the sockets and pins have the same radius as the circle described by the rotational movement thereof. One of the difficulties of providing such a design, is to ensure that the curvatures of the sockets and pins are the same, whilst having constant cross-sectional profiles. If the contacts are machined from solid material e.g. by turning cylindrical pins and sockets out of brass, subsequent bending of the terminals will cause deformation of their cylindrical cross-sectional profiles. One might be able to reduce the deformation of the cross-sectional profile by heating the socket contacts whilst bending, but this would be a slow and expensive procedure.

There is therefore a need to provide receptacle connectors with curved sockets therein for pivotable coupling to pins of complementary male connectors, that are cost-effective, reliable and have cross-sectional profiles substantially unaffected by the bending of the socket contacts.

SUMMARY OF THE INVENTION

It is therefore an object of this invention to provide an electrical connector for pivot coupling to a complementary electrical connector, with socket contacts that are cost-effective to manufacture.

It is a further object of this invention to provide an electrical connector for pivotable coupling to a complementary electrical connector, that provides a reliable electrical connection therebetween yet is cost-effective to produce.

It is a further object of this invention to provide a socket contact that is easily bendable into a curved shape without any substantial deformation of it's cross-sectional profile.

The objects of this invention have been achieved by providing a socket contact comprising a longitudinal contact body having a longitudinal cavity therein for receiving a male contact, wherein the contact body comprises slots transverse to the longitudinal direction and intersecting the cavity for allowing supple bending of the contact body, and whereby the contact body is bent into a curved shape adapted to receive the male contact pivotely inserted therein. A further advantageous feature is the provision of transverse slots alternately extending from opposite sides of the contact body so as to form an organ shaped contact body.

DETAILED DESCRIPTION OF THE PREFERRED EMBODIMENT

Figure 1:
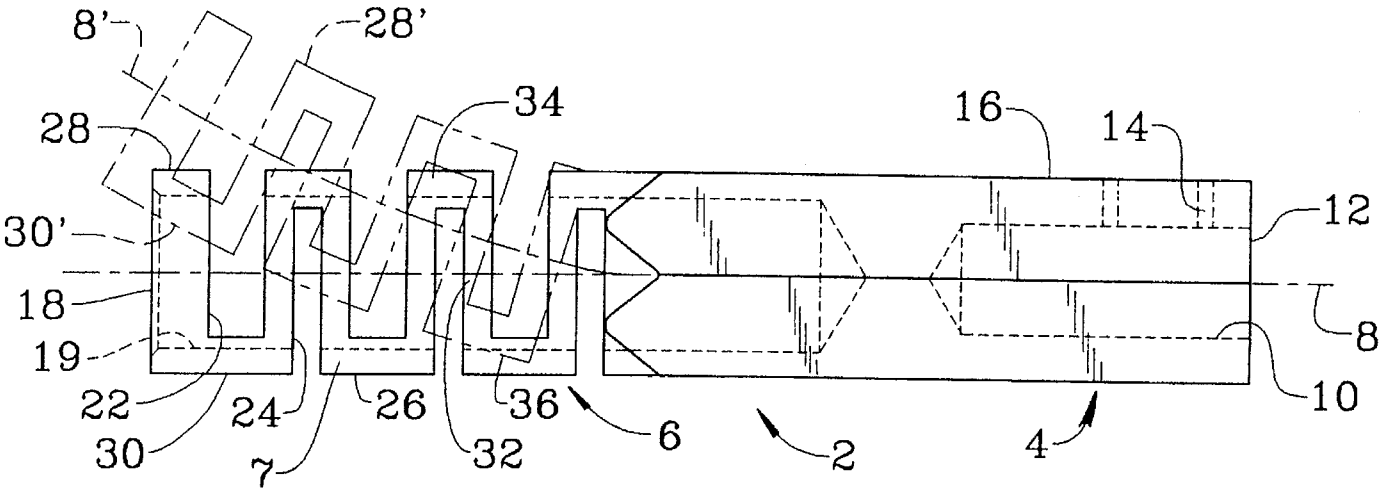
FIG. 1 is a side view of a socket contact according to this invention.

Referring first to FIG. 1, a socket contact 2 machined out of a conductive material, comprises a connection section 4 and a contact section 6 extending along a longitudinal axis 8 in the free standing (unassembled) position. The connection section 4 comprises a cylindrical cavity 10 extending therein from a conductor receiving end 12. A threaded bore 14 extends from an outer periphery 16 of the connection section to the connection cavity 10 for receiving a screw to clamp a conductor (not shown) inserted into the cavity 10. The outer periphery 16 of the connection section 4 has a hexagonal cross-sectional profile.

Figure 3:
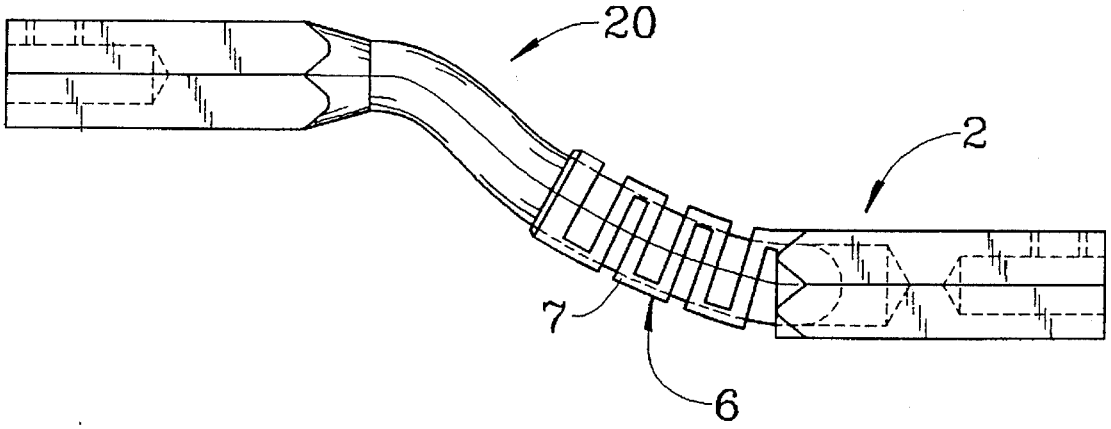
FIG. 3 is a side view of a socket contact of FIG. 1 coupled to a complementary connector having male pin.

At an opposite complementary terminal receiving end 18, a cylindrical cavity 19 extends into the contact section 6 and is for receiving a cylindrically profiled complementary male pin terminal 20 as shown in FIG. 3. The contact section 6 has a machined contact body 7 and comprises slots 22, 24 that extend from an outer cylindrical periphery 26 transversely enter the contact body 7, the slots 22, 24 intersecting the cavity 19 substantially perpendicularly to the longitudinal axis 8. Adjacent slots 22, 24 respectively extend alternately from opposing inner and outer sides 28, 30 of the periphery 26 such that the contact body 7 has the shape of an organ having transverse wall portions 32, joined at opposing ends to adjacent transverse wall portions by bridging portions 34, 36 respectively.

The slots 22 have a greater width than the slots 24 and therefore the bridging portions 36 are longer than the bridging portions 34. The transverse slots 22, 24 make the contact body 7 very supple with respect to bending, and as is shown by the dotted line, the contact section 6 can be easily bent to extend along a substantially circular portion of a curved axis 8'. When bent into a curved shape 28', 30', the side 28 has a smaller radius of curvature than the side 30 which is the reason for having shorter bridging portions 34 proximate the inner side 28 than the bridging portions 36 proximate the outer side 30. The latter dimensions can be provided for optimal stress distribution in the contact body 7 when being bent at a given radius of curvature.

Figure 2:
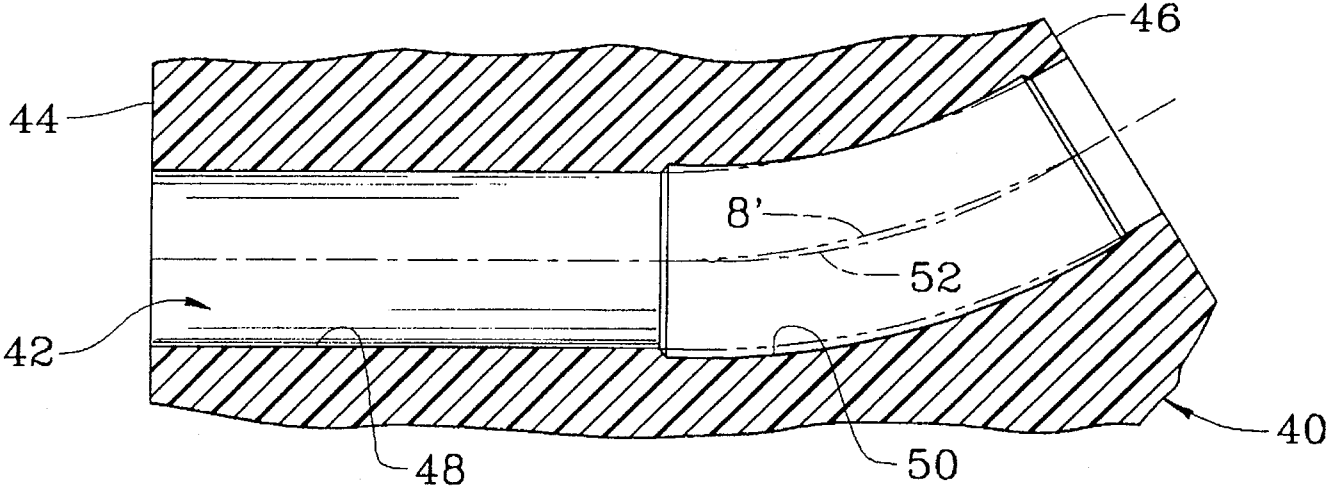
FIG. 2 is a cross-sectional view through part of a connector housing for receiving the socket contact of FIG. 1.

Referring now to FIG. 2, a partially shown connector housing 40 comprises a socket receiving cavity 42 therein, extending from a connection end 44 to a mating end 46. The cavity 42 comprises a straight connection end portion 48 and a curved contact receiving portion 50 that has a radius of curvature of it's axis 52 that is slightly smaller than the final radius of curvature of the axis 8' of the socket contact 2.

Assembly of the socket contact 2 into the cavity 42, is as follows: firstly the contact section 6 is inserted into the cavity connection section 48, whereby on further insertion the contact section 6 enters into the cavity contact section 50 and is progressively bent along it's whole length to adopt the curved shape of the cavity section 50, whereby the contact connection section 4 remains in the straight cavity connection section 48. Due to the elastic resilience of the contact body 7, and the play that is required in the cavity section 50 to allow assembly of the contact therein, the resultant radius of curvature of the contact axis 8' will be slightly greater than the radius of curvature of the cavity axis 52.

The transverse slots 22, 24 hence enable simple manufacturing of the contact section 6 as it can be produced as a straight piece, but nevertheless providing a means of easily bending the contact section 6 into a curved shape by merely inserting the contact into a housing cavity with the required curvature. Furthermore, the pin receiving cavity 19 of the contact section 6 remains substantially cylindrical in profile, and is therefore well adapted to snugly receive the cylindrical profile of the curved male pin contact 20 as shown in FIG. 3. A further advantage of the supple bending of the contact section 6 is the adaptation of the contact section, along it's whole length, to suit the curvature of the male pin contact 20 for a snug fit. Electrical contact therebetween is therefore very good. The bending flexibility also has the advantage of reducing the insertion forces of the male pin into the socket, as any difference in curvature between the two is absorbed by the supple bending of the socket contacts, whereby a rigid socket contact in the bending direction would have high frictional forces if there are slight differences in curvature between the male pin and female socket. An additional advantage of the provision of slots, is the reduced weight of the contact.

Figure 4:
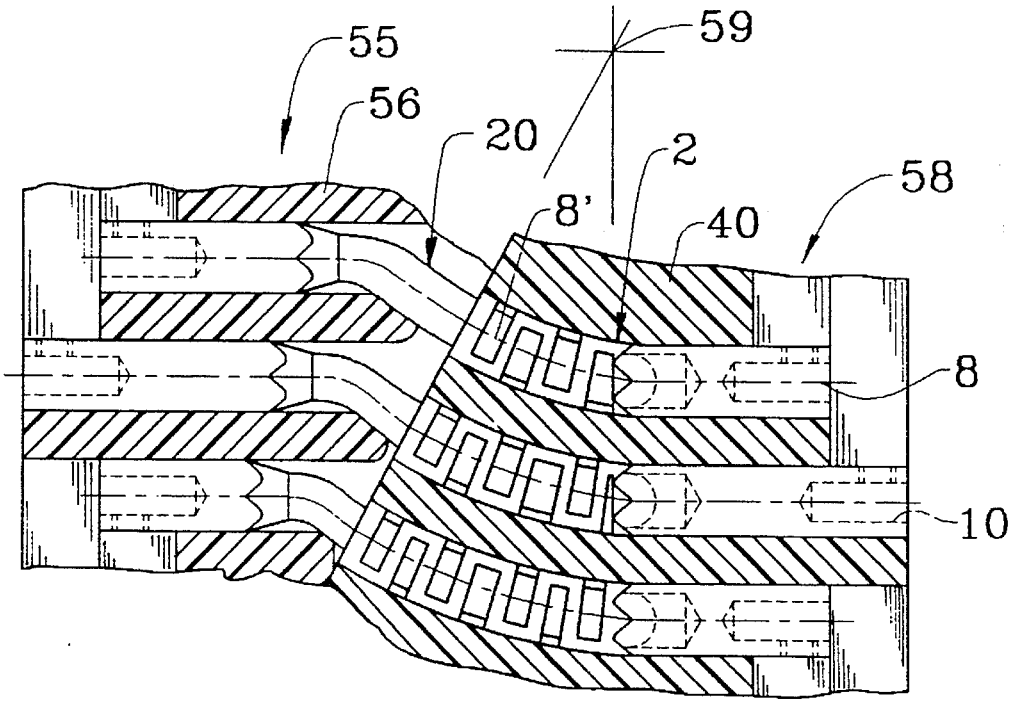
FIG. 4 is a partial cross-sectional view of a connector comprising socket contacts coupled to a complementary connector having male pins.

Referring now to FIG. 4, a complementary connector 55 is partially shown, comprising a plurality of male pin contacts, 20 mounted in a housing 56 and mated to socket contacts 2 of a female connector 58, the coupling between the male and female connectors effectuated by pivoting the connectors together about a pivot axis 59 positioned at the centre of the radii of curvature of the various contacts.

Advantageously therefore, provision of transverse slots in the socket contact makes it cost-effective to manufacture, easier to assemble into a connector housing and provides good and reliable electrical connection to a complementary curved pin terminal inserted by pivot action therein.

I claim:

1. A socket contact comprising a contact body having a longitudinal cavity disposed around and extending along an axis, the cavity for receiving a male contact therein for electrical connection therewith, characterized in that the contact body comprises slots extending from an outer periphery of the body transverse to the axis and intersecting the cavity for allowing supple bending of the contact body in a direction transverse to the axis from a free standing position to a connection position, the contact body being bent into a curved shape in it's connection position, the curvature adapted to receive the male contact inserted into the cavity by rotational movement in a direction along the axis, wherein adjacent said slots extend respectively from alternating opposing sides of the outer periphery.

2. The socket contact of claim 1 characterized in that one of the sides is an inner side disposed on the inner curved side of the contact body, and the other side is an outer side disposed on the outer curved side of the contact body, when the contact body is bent into a curved shape, wherein the slots extending from the inner side are wider than the slots extending from the outer side.

3. A receptacle connector comprising a housing with a socket receiving cavity surrounding and extending along an axis thereof, and a socket contact for insertion into the cavity, the socket contact having a contact body having a cavity therein for mating with a complementary curved pin terminal, wherein the socket receiving cavity comprises a curved section such that the cavity axis is curved along this section, for receiving the contact body, wherein the contact body is supple and bent into a curved shape conforming to the curved shape of cavity curved section when inserted thereinto.

4. The connector of claim 3 characterized in that the contact body comprises slots extending from an outer periphery of the body and transversely intersecting the pin receiving cavity.

5. The connector of claim 4 characterized in that adjacent said slots extend respectively from alternating opposing sides of the outer periphery.

6. The connector of claim 5 characterized in that one of the sides is an inner side disposed on the inner curved side of the contact body, and the other side is an outer side disposed on the outer curved side of the contact body, when the contact body is bent into a curved shape, wherein the slots extending from the inner side are wider than the slots extending from the outer side.

7. A method of assembling a receptacle connector for pivot connection to a complementary pin connector having pin terminals, the receptacle connector comprising an insulative housing, cavities therein for receiving socket contacts, and socket contacts having contact bodies for mating with the pin terminals, characterized by: providing the cavities with curved sections, and the socket contacts with substantially straight but supple and bendable said contact bodies; inserting the contact bodies into the cavity curved sections such that the contact bodies are bent into curved shapes for pivot insertion of the pin terminals therein.

8. The method of claim 7 characterized in that the contact bodies are provided with transverse slots intersecting pin receiving cavities of the contact bodies.

9. The method of claim 8 characterized in that the slots extend respectively from alternating opposing sides of the contact bodies.

* * * * *